US012326104B2

(12) United States Patent
Ott

(10) Patent No.: US 12,326,104 B2
(45) Date of Patent: Jun. 10, 2025

(54) OIL SUMP WITH OIL DRAIN PLUG

(71) Applicant: Bayerische Motoren Werke Aktiengesellschaft, Munich (DE)

(72) Inventor: Gerwin Ott, Steyr (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 18/038,766

(22) PCT Filed: Nov. 8, 2021

(86) PCT No.: PCT/EP2021/080935
§ 371 (c)(1),
(2) Date: May 25, 2023

(87) PCT Pub. No.: WO2022/128255
PCT Pub. Date: Jun. 23, 2022

(65) Prior Publication Data

US 2023/0417164 A1 Dec. 28, 2023

(30) Foreign Application Priority Data

Dec. 18, 2020 (DE) ..... 10 2020 134 074.5

(51) Int. Cl.
*F01M 11/00* (2006.01)
*F01M 11/04* (2006.01)

(52) U.S. Cl.
CPC ..... *F01M 11/0408* (2013.01); *F01M 11/0004* (2013.01); *F01M 2011/0416* (2013.01)

(58) Field of Classification Search
CPC ..... F01M 11/408; F01M 11/0004; F01M 2011/0416; F16N 31/006
(Continued)

(56) References Cited

U.S. PATENT DOCUMENTS 4,084,655 A * 4/1978 Savron ..... F16N 31/006 180/69.1
4,119,178 A * 10/1978 Hass ..... F01M 11/0408 184/1.5

(Continued)

FOREIGN PATENT DOCUMENTS

DE 10 2015 218 320 A1 3/2017
JP 51-65134 U 5/1976

(Continued)

OTHER PUBLICATIONS

"Engine Oil Drain Plug", Dorman, Dorman Products, 2024, accessed Mar. 13, 2024, (https://www.dormanproducts.com/p-102215-090-053cd.aspx) (Year: 2024).*

(Continued)

*Primary Examiner* — Henry Y Liu
*Assistant Examiner* — Katelynne R Burrell
(74) *Attorney, Agent, or Firm* — Crowell & Moring LLP

(57) ABSTRACT

An oil sump with an oil drain channel for a motor vehicle has an oil sump wall with an oil sump inner side. The oil sump inner side delimits an oil sump storage space at least in some sections. The oil sump wall has an oil sump outer side, which faces an environment surrounding the oil sump. The oil sump further has two states, with, in the first state, a liquid medium being receivable and storable in the oil sump storage space, and in the second state, the oil sump storage space being fluidically connected to the environment surrounding the oil sump such that a liquid medium received can exit through the oil drain channel in an oil drain direction into the environment. The oil drain channel has an oil channel extension direction at least in the region of the transition from the oil sump wall into the environment surrounding the oil sump, which oil channel extension direction forms an angle of more than 85° and less than 95° in relation to a direction of the force of gravity, based on a (Continued)

correct installation position of the oil sump. An oil sump drip lug is arranged on the oil sump outer side, adjacently to the oil drain channel and protrudes at least 1 mm relative to an environment directly adjacent to the oil sump outer side.

6 Claims, 3 Drawing Sheets

(58) Field of Classification Search
USPC ..... 184/6.4, 106
See application file for complete search history.

(56) References Cited

U.S. PATENT DOCUMENTS 4,417,552 A * 11/1983 Walter ..... F01M 11/0004 181/204
4,938,314 A * 7/1990 Sitzler ..... F01M 11/0408 184/1.5
8,960,370 B2 * 2/2015 Langwald ..... F16K 1/04 184/1.5
10,487,709 B2 * 11/2019 Xu ..... F01M 11/0004
2004/0099481 A1 5/2004 Mitchell
2012/0241452 A1 * 9/2012 Langwald ..... F01M 11/0408 251/216
2018/0066551 A1 3/2018 Weber et al.
2018/0073403 A1 * 3/2018 Xu ..... F01M 11/0004

FOREIGN PATENT DOCUMENTS

JP 2002-97918 A 4/2002
JP 2011-7083 A 1/2011
WO WO 2020/083485 A1 4/2020

OTHER PUBLICATIONS

Ono, Masaharu, JP200297918 Translation, 2024, Clarivate Analytics (Year: 2024).*
International Search Report (PCT/ISA/210) issued in PCT Application No. PCT/EP2021/080935 dated Mar. 9, 2022 with English translation (5 pages).
German-language Written Opinion (PCT/ISA/237) issued in PCT Application No. PCT/EP2021/080935 dated Mar. 9, 2022 (8 pages).
German-language Search Report issued in German Application No. 10 2020 134 074.5 dated Oct. 1, 2021 with partial English translation (17 pages).

* cited by examiner

OIL SUMP WITH OIL DRAIN PLUG

BACKGROUND AND SUMMARY

The invention relates to an oil sump with an oil drain plug for use with an engine for a motor vehicle. An oil sump for an engine of a motor vehicle and an oil drain plug for an oil sump of this type are known from the prior art, in particular from DE 10 2015 218 320 A1.

The invention is explained below in connection with an oil sump of an internal combustion engine in a motor vehicle. This is not to be construed as restricting the invention to a configuration of this type.

An internal combustion engine with a reciprocating piston construction usually has what is known as an oil sump, in which oil for lubricating the internal combustion engine is received. The oil or engine oil is changed routinely and can be drained for this purpose from the oil sump through an opening therein. This oil emission opening is usually closed by means of an oil drain plug. If the oil drain plug is removed, the oil can pass from the oil sump to the exterior. The oil drain plug for draining the engine oil from the oil sump may be arranged either vertically or horizontally in the oil sump. Furthermore, it is in principle also conceivable to position the oil drain plug in an oblique or inclined manner, although problems may arise in particular when the oil drain plug is arranged horizontally. In the present case, therefore, a level or horizontal arrangement of the oil drain plug is addressed, in which the oil drain plug is thus inserted in a level manner into the oil sump.

As explained, the oil drain plug is removed to drain engine oil from the oil sump and the oil then streams from the oil drainage opening released by the oil drain plug to the exterior, generally into a collecting tray. The engine oil level in the oil sump is initially high and the action of gravity drives the issue of engine oil from the oil sump in such a way that the engine oil issues from the engine oil sump at a "high" rate. As the fill level of engine oil in the oil sump falls, the flow rate of the engine oil from the oil sump decreases. Toward the "end" of the oil change, the flow rate of the engine oil may be so low that the action of the adhesive power between the issuing engine oil and the outer surface of the oil sump exceeds, at least in part, the discharging effect. In such a case, the engine oil being discharged is "pulled" along the outer oil sump surface, in particular counter to the original direction of issue of the engine oil from the oil sump, and the oil sump surface is soiled by the engine oil. The effect which occurs is generally described as the "teapot effect" and is a known phenomenon.

On this basis, it is an object of the invention to provide an oil sump which has improved operating characteristics and which therefore in particular allows engine oil to flow from the oil sump in an improved manner. This object is achieved by an oil sump according to the independent claims. Preferred developments form the subject matter of the dependent claims.

Within the meaning of the invention, an oil sump is to be understood to mean a container for receiving a liquid medium which, in particular when assembled with an internal combustion engine, preferably an internal combustion engine with a reciprocating piston construction, forms a storage chamber for the liquid medium, preferably engine oil and which, in a planned installation position, is preferably arranged geodetically below the internal combustion engine. Oil sumps as such are known from the prior art and are routinely used with internal combustion engines such as Otto engines or diesel engines, in particular as engines for motor vehicles.

The proposed oil sump further has an oil drainage channel, wherein within the meaning of the invention an oil drainage channel of this type is to be understood to mean an opening in an oil sump wall which is selectively closable by means of an oil drain plug. The oil sump further has an oil sump wall, wherein the oil sump wall has an oil sump inner side with which the oil sump wall delimits, at least in portions, an oil sump storage chamber. As explained, the oil sump, in particular together with an internal combustion engine, preferably a crankcase of the internal combustion engine, forms a storage chamber for receiving the liquid medium and therefore the oil sump storage chamber is delimited, at least in portions, by the oil sump inner side. The oil sump wall further has an oil sump outer side which faces an environment surrounding the oil sump.

As explained above, in connection with the invention, it is possible to differentiate between two states of the oil sump. In the first state, known as the operating state, a liquid medium is receivable and storable in the oil sump storage chamber. Receivable and storable are to be understood in this context to mean that the oil drainage channel is blocked in such a way that the liquid medium is receivable in the oil sump storage chamber on a long-teen basis. The oil sump further has a second state, known as the oil drainage state, wherein in this second state the oil sump storage chamber is connected in a fluid-conducting manner with the environment surrounding the oil sump by means of the oil drainage channel through the oil sump wall in such a way that a liquid medium received in the oil sump storage chamber can issue into the environment surrounding the oil sump, or issues into the environment, through the oil drainage channel in an oil drainage direction.

The oil drainage channel extends, at least in the region of the transition from the oil sump wall to the environment surrounding the oil sump, in a direction of extent of the oil channel. Figuratively speaking, the direction of extent of the oil channel in this region can be understood to mean the discharge direction of a notional liquid medium which the liquid medium would follow when issuing from the oil drainage channel into the environment surrounding the oil sump. More preferably, in a planned installation position of the oil sump, the direction of extent of the oil channel encloses, together with the action direction of gravity, known as the direction of action of gravity, an angle of more than 85° and less than 95°. In other words, the liquid medium would issue at least substantially horizontally, or orthogonal to the direction of action of gravity, from the oil drainage channel, provided that the latter is open, in particular therefore in the second state of the oil sump.

It is proposed, in particular to prevent engine oil which has issued from the oil drainage channel from streaming back on the oil sump outer side, that an oil sump drip projection which protrudes at least 2 mm relative to a directly adjacent environment of the oil sump outer side is arranged on the oil sump outer side adjacent to the oil drainage channel. Protrude is preferably to be understood to mean that the oil sump drip projection extends in the direction of action of gravity. More preferably, the oil sump drip projection tapers, at least in portions, starting from an oil sump drip projection base toward an oil sump drip projection tip. More preferably, at least one oil sump drip projection of this type is arranged on the oil sump outer side and preferably, at least two or more preferably, a plurality, of oil sump drip projections are arranged on the oil sump outer side. On a functional basis, this makes it possible for in particular engine oil which reaches the oil sump drip projection on the oil sump outer side after being discharged from the oil drainage channel to reach the oil sump drip projection tip from the oil sump drip projection base under the action of gravity and, from there, to detach from the oil sump drip projection. In particular, a configuration of this type of the oil sumps makes it possible for in particular engine oil which would soil the oil sump on the oil sump outer side in conventional oil sumps, in particular due to the "teapot effect", to accumulate at the at least one oil sump drip projection and to detach therefrom, in such a way that the invention at least reduces or prevents the wetting, in particular the undesired wetting, of the oil sump outer side when the engine oil is drained.

In a preferred embodiment the at least one oil sump drip projection is arranged in a region on the oil sump outer side which lies opposite the oil drainage channel extending through the oil sump wall, or the at least one oil sump drip projection is arranged in the region on the oil sump wall which delimits the oil drainage channel in the oil sump wall. More preferably, the oil sump drip projection is therefore arranged in the region of the oil outflow channel. More preferably, the oil sump drip projection is arranged opposite a geodetically lowest point of the oil drainage channel on the oil sump outer side. More preferably, the oil sump drip projection is located at a distance of less than 100 mm, preferably less than 50 mm from where the oil drainage channel issues from the oil sump into the environment surrounding the oil sump. In particular, an arrangement of this type of the oil sump drip projection makes it possible for there to be a short distance between the location at which the liquid medium issues from the oil drainage channel and the oil sump drip projection, in such a way that liquid medium, in particular when the latter wets the oil sump outer side due to the "teapot effect", only wets a small region of this oil sump outer side before it reaches the oil sump drip projection in a targeted manner and detaches therefrom and therefore does not wet any further regions of the oil sump outer side.

In a preferred embodiment of the invention, the oil drainage channel terminates in the environment surrounding the oil sump at a planar oil drainage channel sealing face. Preferably, in the first state of the oil sump, the oil drain plug is attached to this oil drainage channel sealing face, preferably by means of a seal, and thus seals the oil sump in this region in the first state of the oil sump in a fluid-tight manner relative to the environment surrounding the oil sump. More preferably, the oil sump drip projection extends up to the oil drainage channel sealing face and terminates there with an oil sump drip projection end face. More preferably, the oil drainage channel sealing face is produced by means of a cutting manufacturing method or has an elevated surface quality at least relative to these surrounding regions of the oil sump outer side, as is conventional for "sealing faces". More preferably, the oil sump drip projection end face of the oil sump drip projection is a portion of this planar oil drainage channel sealing face. Preferably, therefore, the oil sump drip projection end face and the oil drainage channel sealing face are two regions of a single planar face. In particular, with a configuration of this type, a sharp-edged transition which promotes detachment of the liquid medium from the oil sump outer face is formed at the transition from the oil sump drip projection end face to the rest of the oil sump outer face. Within the meaning of the invention, sharp-edged is to be understood to mean a transition between two faces, wherein a transition radius between these faces is less than or equal to 0.5 mm, or more preferably, the two faces transition into each another with no radius, more preferably the two faces which transition into each other are at an angle of 90° or more at the transition thereof.

In a further preferred embodiment, the transition from the oil drainage channel sealing face to the oil sump outer side is formed so as to be sharp-edged, at least in portions or in full.

Tests have shown that a transition of this type makes it possible to improve the detachment of the liquid medium from the oil sump outer side at the oil sump drip projection.

In a preferred embodiment, on the oil sump outer side, counter to the direction of extent of the oil channel, and therefore in relation to this direction, it also being possible to interpret a direction of this type as the backstream direction, at least one oil drip rib is provided after the oil sump drip projection. Within the meaning of the invention, the oil drip rib is to be understood to mean a protruding portion on the oil sump outer side. The oil drip rib is preferably arranged at a distance of 50 mm at most from the oil sump drip projection. More preferably, the oil drip rib extends at least 10 mm in a direction substantially orthogonal to the direction of extent of the oil channel. More preferably, the oil drip rib therefore has a longitudinal extent at least substantially orthogonal to the direction of extent of the oil channel.

More preferably, the oil drip rib is to be understood to mean a barrier for the liquid medium streaming back on the oil sump outer face, in particular due to the teapot effect. More preferably, the oil drip rib is formed as a protruding portion on the oil sump outer face and, more preferably, the oil drip rib is a protruding portion of the oil sump outer face. Preferably, the oil drip rib extends at least 1 mm or more in the direction of action of gravity, in particular relative to the region of the oil sump outer face directly surrounding this oil drip rib. On a functional basis, liquid medium, in particular the liquid medium wetting the oil sump outer face due to the teapot effect, accumulates at the oil drip rib and detaches therefrom due to the protrusion thereof and therefore causes no further wetting of the oil sump outer face. In particular, a configuration of this type of the oil sump makes it possible to further reduce the wetting of the oil sump outer face and thus to describe an improved oil sump.

In a further embodiment of the oil sump, not only one oil drip rib is provided, but in addition to this oil drip rib, at least one or preferably more additional oil drip ribs are provided. More preferably, the further oil drip rib is formed so as to be similar or identical to the oil drip rib. The further oil drip rib is preferably arranged, counter to the oil drainage direction, at a distance from the oil drip rib and therefore, relative to this direction, is arranged after the oil drip rib as a protruding region on the oil sump outer side. In particular, a configuration of this type of the oil sump makes it possible to further reduce the wetting of the oil sump outer face and thus to describe an improved oil sump.

In other words, by means of the proposed invention, an improved oil sump can be achieved in particular by arranging an oil sump drip projection, which can also be understood to mean a collecting rib, on the oil sump outer face. Preferably, the oil sump drip projection is arranged directly adjacent to the oil drainage channel sealing face, and more preferably at least one oil drip rib is arranged adjacent to this oil sump drip projection. The stream of the liquid medium wetting the oil sump outer face, in particular due to the teapot effect, can be collected on at least one of the protruding portions (oil sump drip projection, oil drip rib, further oil drip rib) and this medium can be detached from the oil sump outer face in a targeted manner in accordance with the action of gravity or driven by gravity.

As explained, the oil sump drip projection preferably ends flush with the oil drainage channel sealing face, or a contour is formed in this region of the oil sump by machining the oil sump drip projection end face together with the oil drainage channel sealing face, which contour preferably forms an angle of 90° and in which the oil sump outer face transitions into the oil sump drip projection end face preferably without a corner radius and in particular the liquid medium is collected at this edge.

Individual features and embodiments of the invention will be explained in greater detail below with reference to the drawings. It is hereby pointed out that combinations of features other than those shown are also possible.

DETAILED DESCRIPTION OF THE DRAWINGS

Figure 1:
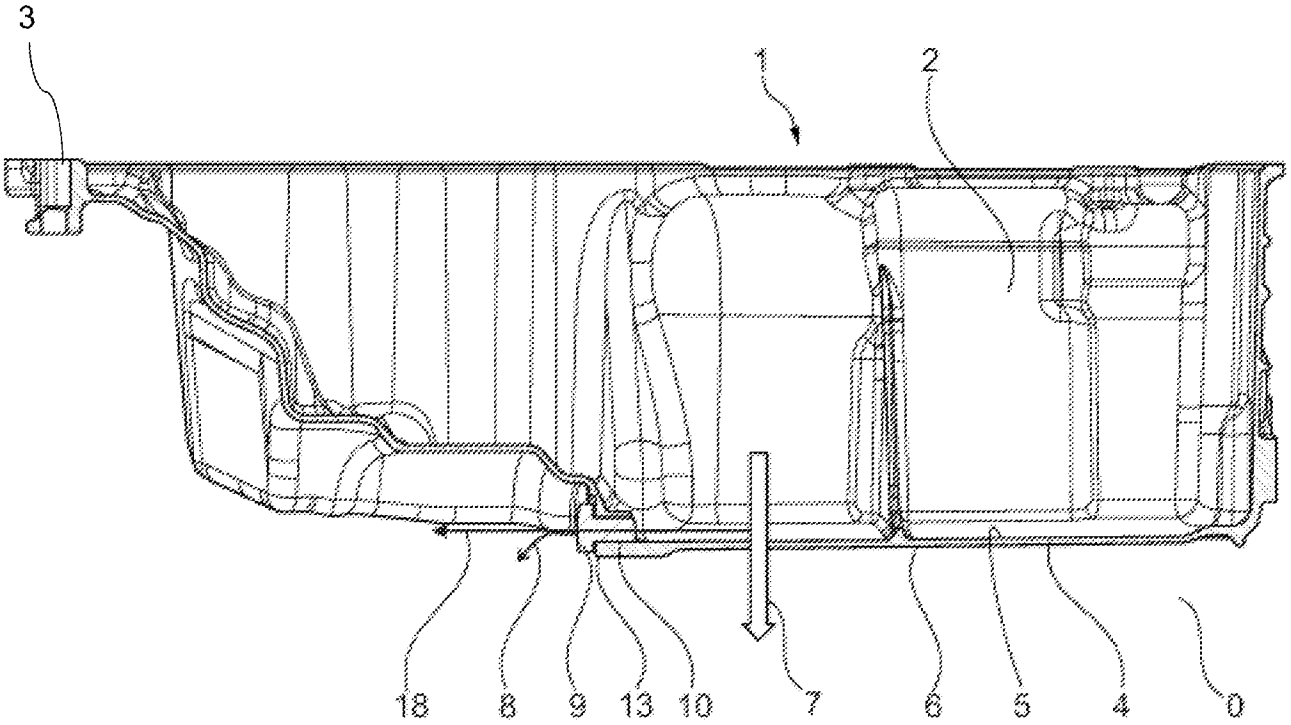
FIG. 1 is a sectional view of the oil sump.

FIG. 1 shows the oil sump 1 with an oil drainage channel 10 in a sectional view. The oil sump 1 shown is a motor vehicle oil sump for fitting to an internal combustion engine. The oil sump 1 has an oil sump wall 4 and can be fastened to the internal combustion engine by means of the fitting hole 3. The oil sump wall 4 has an oil sump inner side 5, wherein this oil sump inner side 5 delimits, in portions, the oil sump storage chamber 2. The oil sump wall 4 has an oil sump outer side 6 which faces an environment 0 surrounding the oil sump.

During routine operation of the oil sump, engine oil is received therein in the oil sump storage chamber 2 and acts to cool and lubricate the internal combustion engine during operation thereof. The engine oil received in the oil sump is subject to an ageing process and is to be changed from time to time. The oil sump therefore has at least two states. In the first state of the oil sump 1, known as the operating state, the engine oil, which is generally to be interpreted as a liquid medium, is received and stored in the oil sump storage chamber 2. The oil sump is blocked for this purpose by means of the oil drain plug 9. More specifically, the oil drainage channel 10 is blocked by the oil drain plug 9 in this state.

The oil sump 1 further has a second state, known as the oil drainage state. In this second state, the oil drainage channel 10 of the oil sump 1 is not blocked by means of the oil drain plug 9. Rather, in this second state, the oil sump storage chamber 2 is connected in a fluid-conducting manner with the environment 0 surrounding the oil sump by means of the oil drainage channel 10. In other words, in this second state of the oil sump, the engine oil received in the oil sump storage chamber 2 can issue through the oil drainage channel 10 in the oil emission stream direction 8 into the environment 0 surrounding the oil sump 1.

The oil drainage channel 10 has, at least in the region of the transition from the oil sump wall 4 into the environment 0 surrounding the oil sump 1, a direction 18 of extent of the oil channel which in the present case encloses an angle of 90°, relative to the direction 7 of action of gravity, based on a planned installation position of the oil sump.

On the oil sump outer side 6, adjacent to the oil drainage channel 10, the oil sump further has an oil sump drip projection 13 which extends at least 2 mm in the direction 7 of action of gravity relative to a directly adjacent environment of the oil sump outer side 6.

Figure 2:
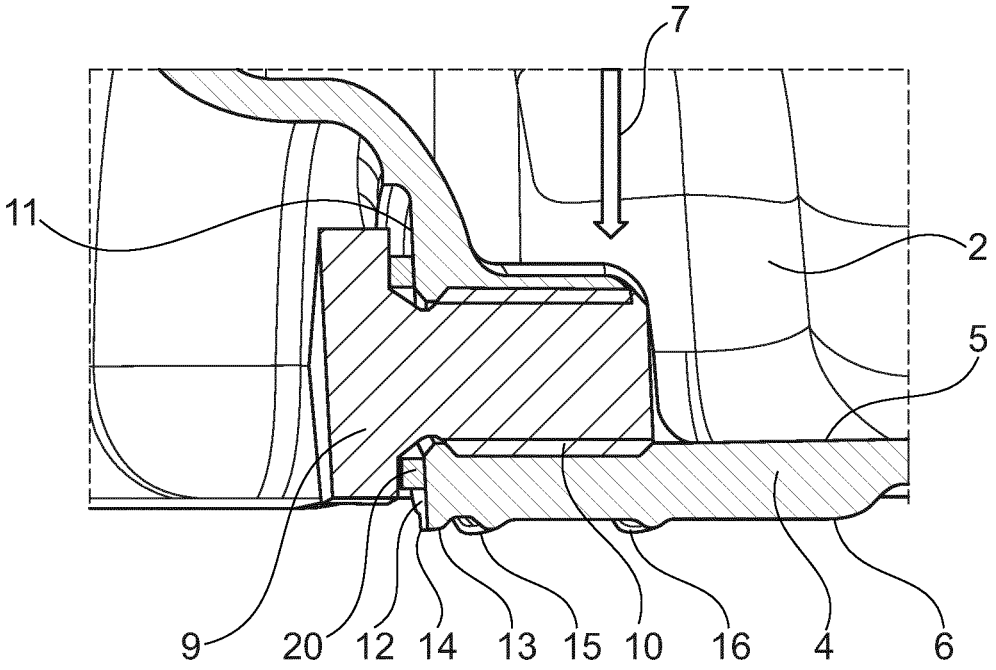
FIG. 2 is a partial sectional view in the region of the oil drainage channel of the oil sump, closed by the oil drain plug.

FIG. 2 shows a detailed sectional view in the region of the oil drainage channel of the oil sump 1. It shows that, in the operating state of the oil sump 1, the oil drainage channel is closed by means of the oil drain plug 9. The oil drain plug 9 seals the oil drainage channel 10 by means of a sealing ring 20. The sealing ring 20 rests on the planar oil drainage channel sealing face 11. The end face, known as the oil sump drip projection end face 12, of the oil sump drip projection 13 is a portion of this oil drainage channel sealing face 11. The oil drainage channel sealing face 11 and therefore the oil sump drip projection end face 12, have a sharp-edged transition 14 to the oil sump outer side 6. Providing the sharp-edged transition 14 at this location makes it possible for engine oil to drip off from the oil sump outer side 6 in an improved manner. Another oil drip rib 15 and a further oil drip rib 16 are arranged on the oil sump outer side 6 adjacent to the oil sump drip projection 13.

Figure 3:
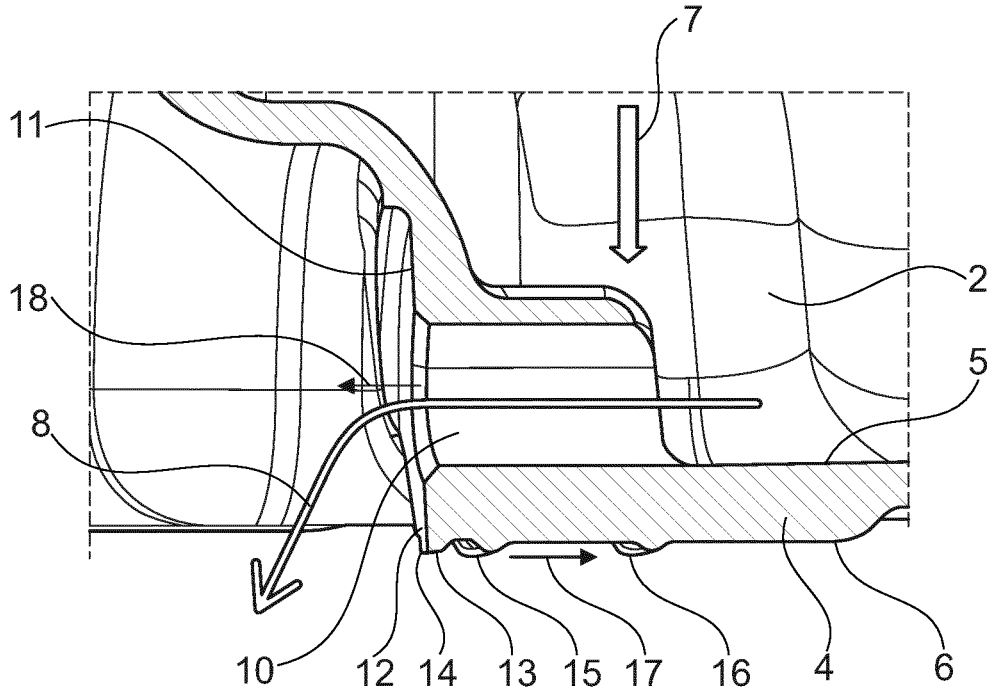
FIG. 3 is a partial sectional view in the region of the oil drainage channel of the oil sump, without the oil drain plug.

FIG. 3 shows the region of the oil sump already known from FIG. 2, but in this case the oil sump shown is in the oil drainage state (second state). In the oil drainage state, the oil drain plug 9 (not shown here) is removed from the oil drainage channel 10. Under the action of gravity in the direction 7 of action of gravity, engine oil received in the oil sump storage chamber would pour in the oil emission stream direction 8 from the oil sump 1 into the environment 0 surrounding the oil sump 1, where it would pour into a collecting tray (not shown). As the engine oil fill level in the oil sump storage chamber 2 falls, the flow rate of the engine oil from the oil drainage channel 10 decreases. When the flow rate falls below a threshold, the "teapot effect" may occur and engine oil wets the oil sump outer side 6, running in the backstream direction 17 as penetrating oil. This type of wetting of the oil sump outer side 6 is not desired. Owing to the oil sump drip projection 13 tapering in the direction 7 of action of gravity, engine oil accumulates at the tip thereof.

Wetting of the oil sump outer side 6 is further reduced by arranging the oil drip rib 15 and the further oil drip rib 16 thereon. The oil drip ribs are arranged after the oil sump drip projection in the backstream direction and mean that further wetting of the oil sump outer side 6 is not only prevented on the oil sump drip projection.

Figure 4:
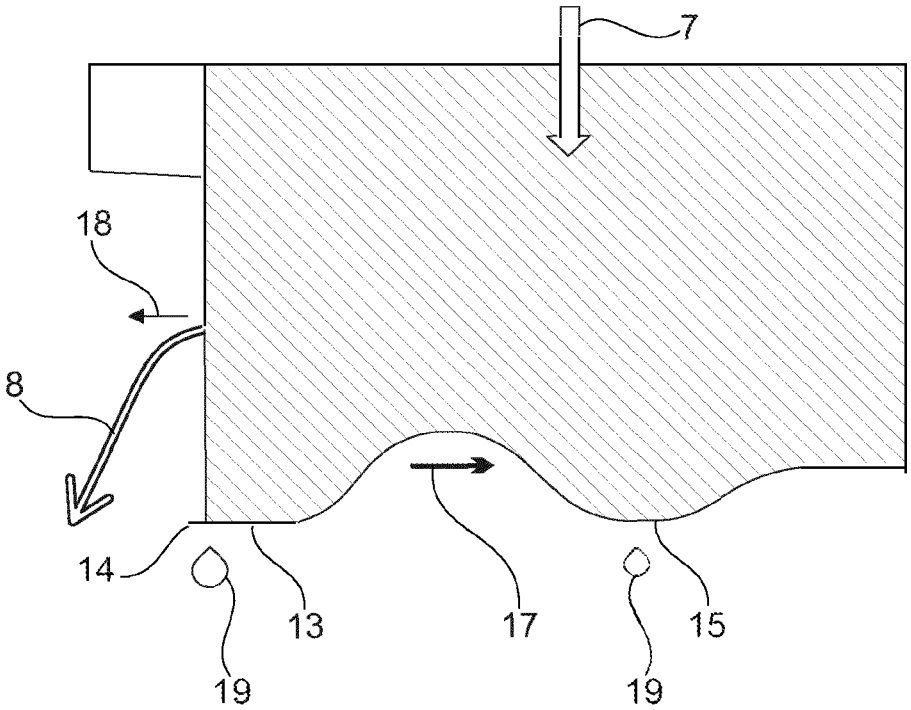
FIG. 4 is a schematic view of the oil sump outer side in the region of the oil drainage channel.

FIG. 4 shows a schematic view of the oil sump drip projection 13, the oil drip rib 15 and engine oil 19 dripping therefrom. In this figure, this dripping engine oil 19 has initially issued from the oil drainage channel 10 at a low rate and subsequently wetted the oil sump outer face 6 in the backstream direction 17. Owing to the shown contour of the oil sump drip projection 13 and the oil drip rib 15, the engine oil then accumulates at the oil sump drip projection 13 and the oil drip rib 15, where it detaches from the oil sump outer side 6 under the action of gravity in the direction 7 of action of gravity.

Figure 5:
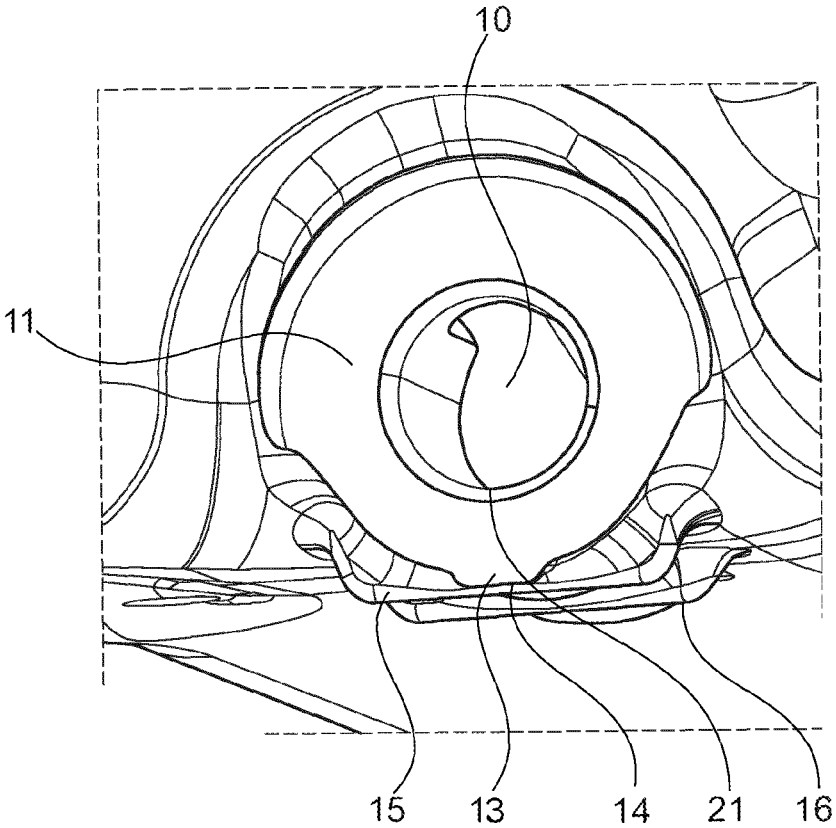
FIG. 5 is a perspective partial view of the oil sump in the region of the oil drainage channel.

FIG. 5 shows a 3-dimensional view of the region of the oil sump 1 around the oil drainage channel 10. It shows how the oil drip rib 15 and the further oil drip rib 16 are arranged after the oil sump drip projection 13 in such a way that engine oil which has not already accumulated at and dripped from the oil sump drip projection accumulates at and drips from the oil drip rib 15 and the further oil drip rib 16. FIG. 5 further shows how the oil sump drip projection 13 is arranged opposite the geodetically lowest point 21 of the oil drainage channel 10.

| List of reference signs: | |
|---|---|
| 0 | environment |
| 1 | oil sump |
| 2 | oil sump storage chamber |
| 3 | fitting hole |
| 4 | oil sump wall |
| 5 | oil sump inner side |
| 6 | oil sump outer side |
| 7 | direction of action of gravity |
| 8 | oil emission stream direction |
| 9 | oil drain plug |
| 10 | oil drainage channel |
| 11 | oil drainage channel sealing face |
| 12 | oil sump drip projection end face |
| 13 | oil sump drip projection |
| 14 | oil drainage channel sealing face |
| 15 | oil drip rib |
| 16 | further oil drip rib |
| 17 | backstream direction on 6 |
| 18 | direction of extent of the oil channel |
| 19 | engine oil dripping from 6 |
| 20 | sealing ring |

The invention claimed is:

1. An oil sump for a motor vehicle, comprising: an oil sump wall having an oil sump inner side delimiting, at least in portions, an oil sump storage chamber, wherein the oil sump wall has an oil sump outer side facing an environment surrounding the oil sump; and an oil drainage channel, wherein the oil sump has two states: (i) in a first, operating state, a liquid medium is receivable and storable in the oil sump storage chamber, and (ii) in a second, oil drainage state, the oil sump storage chamber is connected in a fluid-conducting manner with the environment surrounding the oil sump via the oil drainage channel through the oil sump wall such that the liquid medium received in the oil sump storage chamber exits in an oil drainage direction through the oil drainage channel into the environment surrounding the oil sump, wherein the oil drainage channel, at least in a region of a transition from the oil sump wall to the environment surrounding the oil sump, has an extension direction which forms an angle of more than 85° and less than 95° in relation to a gravitational force direction based on a planned installation position of the oil sump; an oil sump drip projection arranged on the oil sump wall, adjacent to the oil drainage channel, wherein the oil sump drip projection protrudes at least 1 mm, relative to a directly adjacent recessed surface formed on the oil sump wall, and the oil drainage channel terminates in an environment surrounding the oil sump at a circular oil drainage channel sealing end face, the circular oil drainage channel sealing end face having a planar portion at a lowermost end thereof, the planar portion being substantially perpendicular to the circular oil drainage channel sealing end face.

2. The oil sump according to claim 1, wherein the oil sump drip projection is arranged at a location that is opposite to a geodetically lowest point of the oil drainage channel on the oil sump outer side.

3. The oil sump according to claim 1, an oil sump drip projection end face of the oil sump drip projection is a portion of the circular oil drainage channel sealing end face.

4. The oil sump according to claim 3, wherein the oil sump drip projection has a sharp-edge transition from the circular oil drainage channel sealing end face to the oil sump outer side.

5. The oil sump according to claim 1, wherein at least one oil drip rib is provided counter to the direction of extent of the oil channel, and therefore after the oil sump drip projection, the oil drip rib is formed as a protruding portion on the oil sump outer side, and the oil drip rib is arranged at a distance of at most 50 mm from the oil sump drip projection.

6. The oil sump according to claim 5, wherein at least one further oil drip rib is provided, and the at least one further oil drip rib is arranged at a distance, counter to the direction of extent of the oil channel, from the oil drip rib, and therefore after the oil drip rib, as a protruding region on the oil sump outer side.

* * * * *